US008287254B2

(12) United States Patent
Rhein et al.

(10) Patent No.: US 8,287,254 B2
(45) Date of Patent: Oct. 16, 2012

(54) MOTOR AND PUMP ASSEMBLY HAVING IMPROVED SEALING CHARACTERISTICS

(75) Inventors: Robert E. Rhein, Ypsilanti, MI (US); Todd A Frerichs, Waterford, MI (US); Peter Bostwick, Rochester, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/120,675

(22) Filed: May 15, 2008

(65) Prior Publication Data

US 2009/0142208 A1 Jun. 4, 2009

Related U.S. Application Data

(60) Provisional application No. 60/991,472, filed on Nov. 30, 2007.

(51) Int. Cl.

| | |
|---|---|
| ***F04B 23/04*** | (2006.01) |
| ***F04B 41/06*** | (2006.01) |
| ***F04B 17/03*** | (2006.01) |
| ***F04B 35/04*** | (2006.01) |

(52) U.S. Cl. ..... 417/426; 417/410.1

(58) Field of Classification Search ..... 417/410.1, 417/2–8, 426–429, 286–288; 477/156, 157
See application file for complete search history.

(56) References Cited

U.S. PATENT DOCUMENTS

| | | | | |
|---|---|---|---|---|
| 2,573,283 | A * | 10/1951 | Seitz | 318/832 |
| 2,824,273 | A * | 2/1958 | Tilney et al. | 318/761 |
| H1966 | H * | 6/2001 | Henry et al. | 417/356 |
| 6,325,093 | B1 * | 12/2001 | Ooshima | 137/392 |
| 6,638,022 | B2 * | 10/2003 | Shimabukuro et al. | 417/2 |
| 6,882,080 | B2 * | 4/2005 | Tanaka et al. | 310/216 |
| 7,641,450 | B2 * | 1/2010 | Kouno et al. | 417/62 |
| 2003/0179963 | A1 * | 9/2003 | Hokkirigawa et al. | 384/97 |
| 2004/0013541 | A1 | 1/2004 | Sakakibara et al. | |
| 2004/0071559 | A1 * | 4/2004 | Ai et al. | 417/220 |

* cited by examiner

*Primary Examiner* — Devon Kramer
*Assistant Examiner* — Bryan Lettman

(57) ABSTRACT

The present invention comprehends a gerotor or gear pump driven by a permanent magnet motor which exhibits cogging torque, i.e., resistance to rotation when de-energized caused by interaction between permanent magnets in the rotor and teeth on the stator. Such interaction causes the rotor to come to rest in one of many defined rotational positions and resist rotation when electrical power to the motor has been terminated. The permanent magnet motor is coupled, preferably directly, to a gerotor pump having meshing rotors or a gear pump having meshing gears. When the motor is de-energized, the pump rotors or gears come to rest and their rotation is resisted by the cogging torque of the motor. The invention finds particular application in automotive transmissions and systems with parallel pumps.

13 Claims, 2 Drawing Sheets

MOTOR AND PUMP ASSEMBLY HAVING IMPROVED SEALING CHARACTERISTICS

CROSS-REFERENCE TO RELATED APPLICATIONS

This application claims the benefit of U.S. Provisional Application Ser. No. 60/991,472, filed Nov. 30, 2007. The disclosure of the above application is incorporated herein by reference,

FIELD

The present disclosure relates to a motor and pump assembly and more particularly to a motor and pump assembly having improved sealing characteristics which reduce through flow when it is not operating.

BACKGROUND

The statements in this section merely provide background information related to the present disclosure and may or may not constitute prior art.

Pumps for fluids encompass a broad range of mechanical configurations and flow characteristics. One frequent pump flow design requirement is constant or non-pulsating flow. This requirement generally eliminates piston pumps which typically have one or more reciprocating pistons producing a pulsating flow and pressure output. Centrifugal pumps provide a significantly smoother output flow but exhibit performance characteristics that vary widely with speed.

Gerotor and gear pumps represent a middle ground between the foregoing conflicting performance criteria. On the one hand, their construction, which includes two rotating and meshing members, provides a relatively smooth, i.e., non-pulsating, output. On the other, since the pump is essentially a positive displacement type, its speed versus flow and pressure characteristics are essentially proportional. Accordingly, gerotor and gear pumps find wide use in applications requiring a straightforward design, extended service life, minimal pulsation and predictable flow characteristics.

Occasionally, an issue arises with gerotor and gear pumps with regard to sealing between the meshing members and its influence on through flow. i.e., forward and especially reverse flow, when the pump is not operating. Aside from negligible flow between the side and end surfaces of the members and the stationary housing, the most significant flow occurs between the meshing or nearly meshing members. Depending upon the positions of the members and, more specifically, the extent to which any reverse (or forward) flow and pressure is capable of back driving the pump members, there may be an opportunity for relatively significant backward or forward flow through the non-operating pump. Such flow through a non-operating pump is generally undesirable especially in parallel pump installations or installations where air may be drawn through the non-operating pump into the suction side of the operating pump.

SUMMARY

The present invention provides a motor and pump assembly that provides reduced forward or reverse leakage through the pump when it is not operating. The present invention comprehends a gerotor or gear pump driven by a permanent magnet motor which exhibits cogging torque, i.e., resistance to rotation when de-energized caused by interaction between permanent magnets in the rotor and teeth on the stator. Such interaction causes the rotor to come to rest in one of many defined rotational positions and resist rotation when electrical power to the motor has been terminated. The permanent magnet motor is coupled, preferably directly, to a gerotor pump having meshing rotors or a gear pump having meshing gears. When the motor is de-energized, the pump rotors or gears come to rest and their rotation is resisted by the cogging torque of the motor. If the permanent magnet motor is a multiple phase design, additional rotation resisting torque may be generated by energizing one phase of the multiple phase motor. Internal friction within the pump caused by fluid pressure on the pump rotors or gears also inhibits their rotation. The invention finds particular application in automotive transmissions and systems with parallel pumps. It should be appreciated that in addition to gerotor and gear pumps, the present invention encompasses the combination of a permanent magnet motor with any type of positive displacement pump.

Thus it is an object of the present invention to provide a motor and positive displacement pump assembly which achieves minimum through flow when the motor is de-energized.

It is a further object of the present invention to provide a motor and gerotor or gear pump assembly having a permanent magnet motor which resists rotation of the rotors or gears when the motor is de-energized.

It is a still further object of the present invention to provide a motor and gear or gerotor pump assembly having a permanent magnet motor which resists rotation of the pump gears or rotors when one phase of a three phase motor is energized.

It is a still further object of the present invention to provide a motor and pump assembly having minimum through flow in a de-energized state which is especially suited for use in parallel pump installations.

It is a still further object of the present invention to provide a motor and gerotor pump assembly having gears which resist rotation when the motor is de-energized due to increased internal friction caused by fluid pressure acting on the stationary gears.

Further objects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
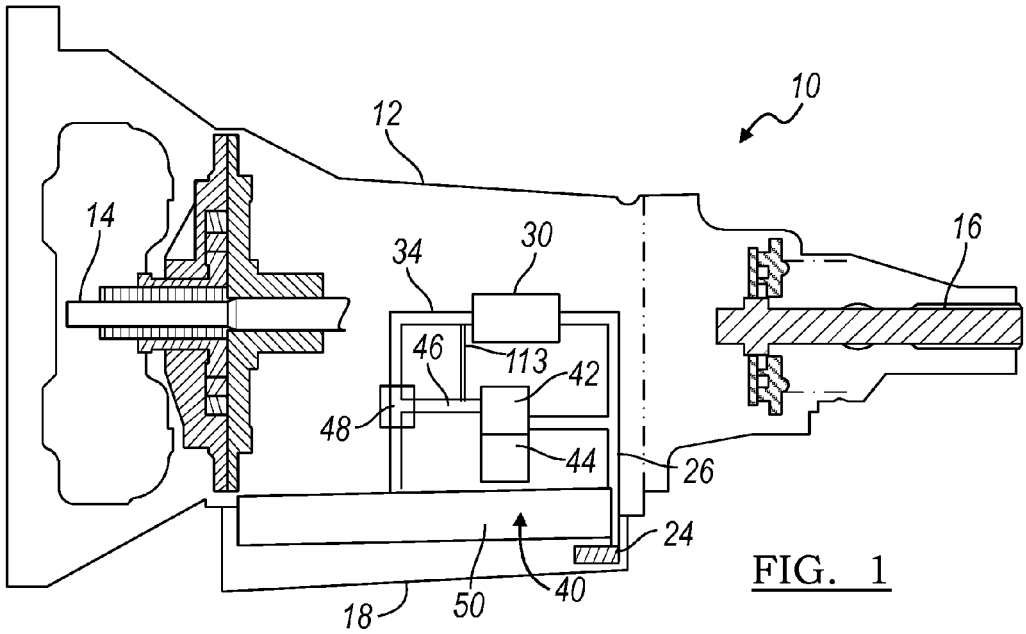
FIG. 1 is a schematic view of an automatic transmission having two hydraulic pumps disposed in parallel.

With reference now to FIG. 1, an automatic transmission incorporating the present invention is illustrated and generally designated by the reference number 10. The automatic transmission 10 includes a metal housing 12 having a plurality of openings, bores, shoulders, flanges and other features which locate, support and secure various components such as, for example, an input shaft 14 and an output shaft 16. The lowest portion of the housing 12 defines a sump 18 which collects hydraulic fluid from the various hydraulic components of the automatic transmission 10. A filter 24 is submerged in the sump 18 and removes particulate matter from hydraulic fluid drawn into a bifurcated suction or inlet line 26 and provided to a first gear pump assembly 30 and a second gerotor or gear pump assembly 40. The first gear pump assembly 30 includes a first gear pump driven by a component of the automatic transmission 10 and provides pressurized hydraulic fluid in a first output or supply line 34. The second gerotor or gear pump assembly 40 includes a second gerotor pump 42 driven by a permanent magnet electric motor 44 and provides pressurized hydraulic fluid in a second output or supply line 46. If desired, a check valve 48 may be disposed at the junction of the supply lines 34 and 46 to reduce back flow to and through the non-operating pump assembly 30 or 40. The first and second supply lines 34 and 46 provide such hydraulic fluid to a transmission controller 50 which includes a plurality of control valves, spool valves and passageways that provide fluid outputs that control various torque transmitting devices such as clutches and brakes in the automatic transmission 10 to achieve operation. Typically, and as illustrated, the supply lines 34 and 46 will combine, either before or within the transmission controller 50.

It will be appreciated that the first gear pump assembly 30 and the second gerotor or gear pump assembly 40 are both utilized in a single automatic transmission 10 to provide different pumping or flow characteristics. For example, since the first gear pump assembly 30 is driven by a component of the automatic transmission 10, it will provide pressurized hydraulic fluid only when such component is rotating whereas the second gerotor pump assembly 40 may be activated or energized as desired or needed to provide pressurized hydraulic fluid. Alternatively, the first gear pump assembly 30 may have higher flow and lower pressure output than the second gerotor pump assembly 40 or vice versa or the second gerotor pump assembly 40 may have better cold temperature pumping characteristics than the first gear pump assembly 30. In any event, it is envisioned that two pumps disposed on parallel will be utilized in the automatic transmission 10 to provide desirable and distinct hydraulic fluid pumping characteristics.

In such an installation, it is highly desirable to reduce or eliminate hydraulic fluid flow through the quiescent, i.e., at rest, gerotor pump assembly 40. As explained above, the present invention is so directed. In this regard, it should be appreciated that while the present invention is especially suited for and described in conjunction with a parallel pump arrangement in an automatic transmission, the invention is equally suitable for use in other devices and in single, i.e., not parallel, or in multiple parallel installations where reduction in flow through the pump or pumps, especially reverse or back flow, when they are not operating, is either desirable or necessary. Moreover, it should be appreciated that while the second pump assembly 40 is described and referenced primarily as a gerotor pump, gear pumps and other positive displacement pumps are within the purview of the present invention.

Figure 4:
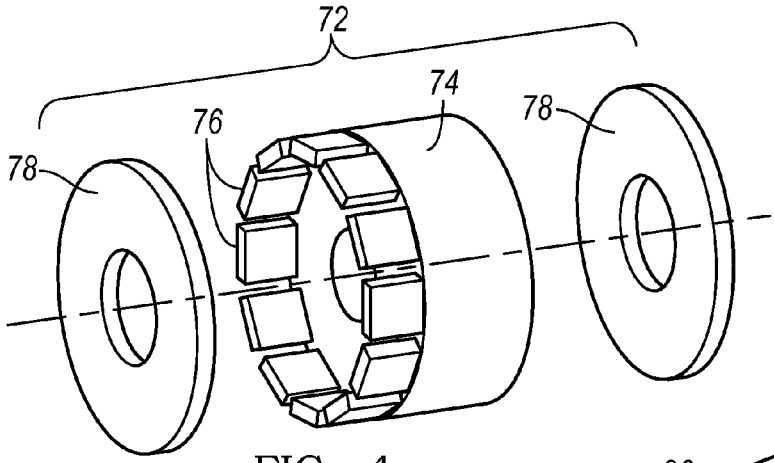
FIG. 4 is an exploded perspective view of a permanent magnet motor rotor according to the present invention.
Figure 2:
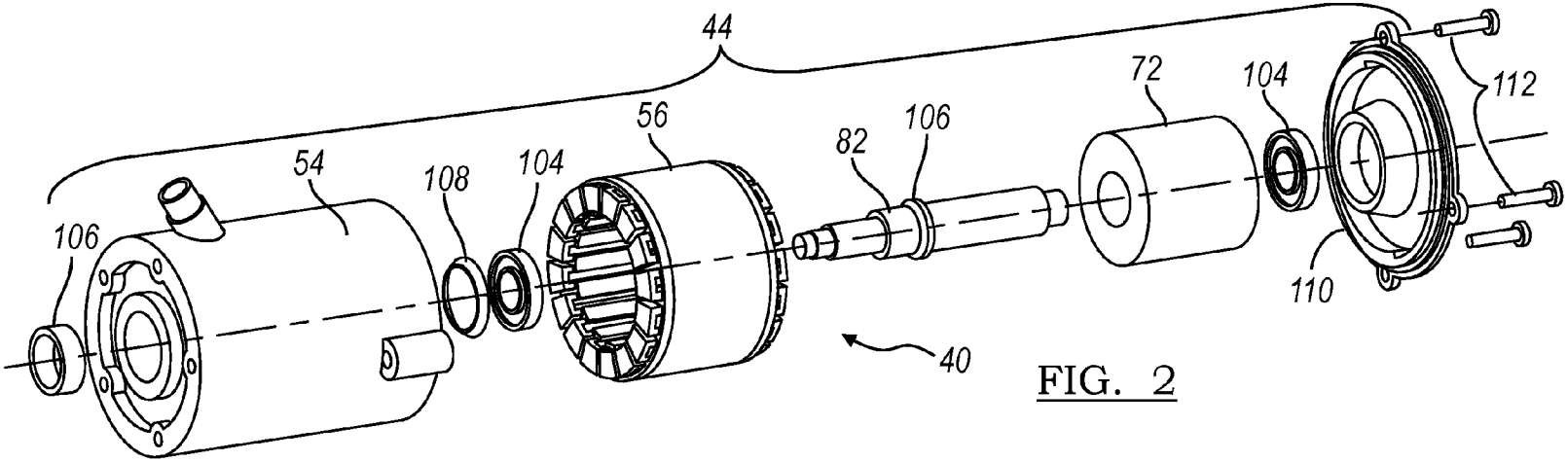
FIG. 2 is an exploded perspective view of a permanent magnet motor according to the present invention.
Figure 3:
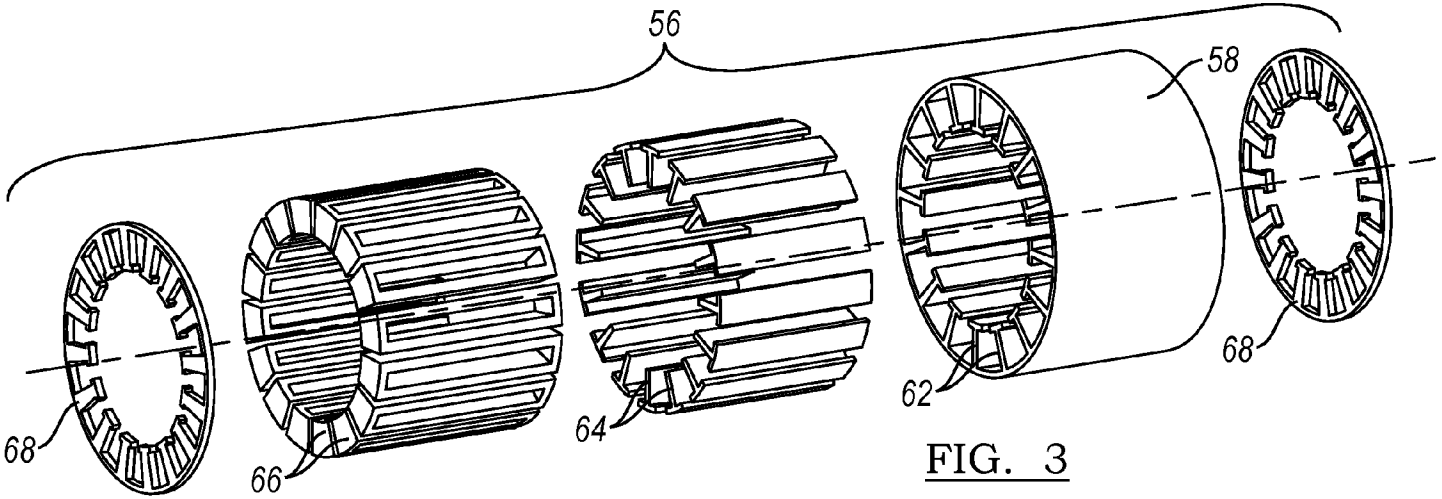
FIG. 3 is an exploded perspective view of a permanent magnet motor stator according to the present invention.

Referring now to FIGS. 2, 3 and 4, the permanent magnet motor 44 of the second gerotor pump assembly 40 which drives the gerotor or gear pump 42 is illustrated. The electric motor 44 is disposed within and protected by a cylindrical housing 54 which supports a stator 56 of the electric motor 44. As illustrated in FIG. 3, the stator 56 comprises a metal stator core 58 defining a plurality of axially extending T-shaped teeth 62. In the current motor design, eighteen T-shaped teeth 62 are utilized in the stator core 58 but it should be understood that more or fewer teeth 62 may be utilized. A plurality of slot liners 64 are received between the teeth 62 and a like plurality of electrical windings 66 are disposed within the slot liners 64 between the teeth 62. The electrical windings 66 may be arranged and connected in either a single or multiple, for example, three, phase configuration. A pair of insulating end caps or spiders 68 complete the stator 56 and protect the electrical windings 66.

Rotatably disposed within the stator 56 is a rotor 72. The rotor 72 includes a cylindrical rotor core 74 which contains a plurality of, for example, twelve, permanent magnets 76. It will be appreciated that more or fewer permanent magnets 76 may be utilized in the rotor core 74. The permanent magnets 76 are arranged with circumferentially alternating north and south poles around the rotor core 74. A balance ring 78 is secured to each end face of the rotor core 74 and the rotor 72 is disposed upon and secured to a stepped drive shaft 82, illustrated in FIG. 2.

Figure 5:
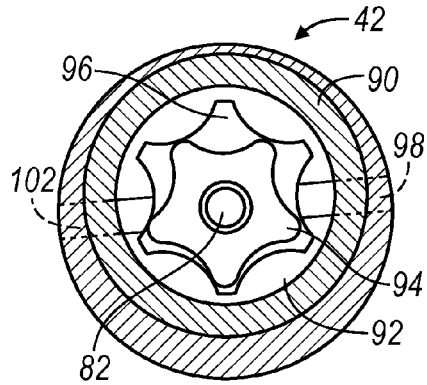
FIG. 5 is an end elevational view of a gerotor pump according to the present invention.

Referring now to FIGS. 1, 2 and 5, the gerotor pump 42 is disposed at one end of and secured to the cylindrical housing 54 of the permanent magnet motor 44 by suitable means (not illustrated) and includes a cylindrical housing 90 which freely rotatably receives an outer rotor 92 surrounding and driven by an inner rotor 94 which is, in turn, driven by the stepped drive shaft 82 of the permanent magnet motor 44. At one side of a pumping chamber 96 defined by the inner surface of the outer rotor 92 and the outer surface of the inner rotor 94 is an inlet or suction port 98. On the opposite side of the pumping chamber 96 is an outlet or pressure port 102.

The permanent magnet motor 44 also includes a plurality of ball bearing assemblies 104 associated with the stepped drive shaft 82 as well as fluid seals 106, a bearing preload washer 108 and an end cap 110 secured to the cylindrical housing 54 by a plurality of threaded fasteners 112.

Pumping operation of the second gerotor pump assembly 40 is essentially conventional. When, however, the flow of electrical power to the permanent magnet motor 44 is terminated, the magnetic force from the permanent magnets 76 will align the rotor 72 with the T-shaped teeth 62 of the stator 56 and thereby produce a rotation resisting torque, the cogging torque of the motor 44. This cogging or rotation resisting (braking) torque is generally sufficient to prevent rotation of the pump rotors 92 and 94 and thus flow through the gerotor pump 42, particularly reverse or backflow. This rotation resisting torque is augmented by friction or binding torque generated by the rotors 92 and 94 when stationary and subjected to reverse (or forward) fluid pressure.

It should be understood that if sufficient rotation resisting (braking) torque is not generated by the permanent magnet motor 44 in its deactivated or de-energized state, such that fluid pressure exerted on the outer rotor 92 and the inner rotor 94 of the gerotor pump 42 is sufficient to rotate the rotors 92 and 94 and cause undesirable flow through the gerotor pump 42, one of the electrical windings 66 of a three phase permanent magnet motor 44 may be energized to increase braking torque to maintain the rotor 72 of the permanent magnet motor 44 and the rotors 92 and 94 of the gerotor pump 42 stationary.

It should also be understood that with the inner rotor 94 as well as the outer rotor 92 stationary due to the cogging torque of the permanent magnet motor 44, fluid pressure in the outlet port 102 and the associated output or supply line 46 may be maintained at a low, positive value with a feed 113 from a pressurized circuit such as the output of the first gear pump assembly 30. This low, positive pressure at the outlet port 102 eliminates the potential for air leakage into the common suction line 26 which is undesirable.

Finally, it should be understood that while the invention has been described primarily in connection with a gerotor pump, it is equally adapted to and will provide the same benefits when using a gear pump and, in fact, any positive displacement pump.

The description of the invention is merely exemplary in nature and variations that do not depart from the gist of the invention are intended to be within the scope of the invention. Such variations are not to be regarded as a departure from the spirit and scope of the invention.

What is claimed is:

1. A motor and pump assembly comprising:

a permanent magnet motor having a motor stator defining a plurality of pole pieces, a motor rotor and an output shaft coupled to the motor rotor;

a positive displacement rotary pump having a pump rotor, an inlet port, an outlet in bi-directional fluid communication with the pump rotor, and a drive shaft driven by the output shaft, wherein the rotary pump is preselected so that the pump rotor has a predetermined rotational resistance;

a transmission driven pump having an inlet and an outlet, the transmission driven pump disposed in parallel with the positive displacement rotary pump, wherein the transmission driven pump is driven by a transmission of a vehicle; and a feed line disposed between the outlet of the transmission driven pump and the pump rotor of the rotary pump, wherein the feed line is preconfigured to directly provide a maximum pressure from the outlet of the transmission driven pump to the pump rotor of the rotary pump, and wherein the maximum pressure provided to the pump rotor of the rotary pump is less than a pressure required to rotate the pump rotor of the rotary pump against the predetermined rotational resistance.

2. The motor and pump assembly of claim 1 wherein the pole pieces define radially inwardly directed teeth, and wherein the teeth have a T-shaped in cross section.

3. The motor and pump assembly of claim 1 wherein the rotary pump is a gerotor pump.

4. The motor and pump assembly of claim 1 wherein the feed line is disposed in a check valve oriented to restrict fluid flow from the outlet of the transmission driven pump to the outlet of the rotary pump.

5. The motor and pump assembly of claim 1 wherein the pump rotor of the rotary pump is coupled to the drive shaft, and wherein the predetermined rotational resistance of the pump rotor includes a cogging torque of the motor.

6. The motor and pump assembly of claim 1 wherein the permanent magnet motor includes three phase windings, and wherein a first of the three phase windings is independently energizeable to determine a portion of the predetermined rotational resistance of the pump rotor of the rotary pump.

7. An automatic transmission having a transmission controller and a sump for hydraulic fluid, the automatic transmission comprising:

a first pump having an inlet and an outlet, wherein the first pump is rotatable with a component of the automatic transmission;

a permanent magnet motor, wherein the permanent magnet motor is preselected to have a predetermined cogging torque;

a second pump having a pump rotor, an inlet, and an outlet, wherein the outlet of the second pump is in bi-directional fluid communication with the pump rotor, and wherein the pump rotor is coupled for common rotation with the permanent magnet motor;

a first fluid passage in fluid communication with the sump, the inlet of the first pump, and the inlet of the second pump;

a second fluid passage in fluid communication with the transmission controller, the outlet of the first pump, and the outlet of the second pump; and a pressurized feed line disposed between the outlet of the first pump and the pump rotor of the second pump, wherein the pressurized feed line is preselected to provide a predetermined pressure directly to the pump rotor of the second pump from the outlet of the first pump, and wherein the predetermined pressure does not rotate the pump rotor of the second pump against the predetermined cogging torque of the permanent magnet motor.

8. The automatic transmission of claim 7 wherein the permanent magnet motor includes a first phase winding, a second phase winding, and a third phase winding, and wherein the first phase winding is energizeable independent of the second phase winding and the third phase winding.

9. The automatic transmission of claim 7 wherein the permanent magnet motor includes a motor rotor coupled to an output shaft and a motor stator having a plurality of T-shaped teeth, wherein the output shaft is rotatable with the second pump.

10. The automatic transmission of claim 7 wherein the second pump is a gerotor pump.

11. The automatic transmission of claim 7 further including a valve assembly disposed in the second fluid passage and oriented to restrict fluid flow from the outlet of the first pump to the outlet of the second pump.

12. The automatic transmission of claim 11 wherein the pressurized feed line is integral with the valve assembly to communicate the predetermined pressure to the pump rotor of the second pump.

13. The motor and pump assembly of claim 7 wherein the permanent magnet motor includes three phase windings, and wherein a first phase winding of the three phase windings is energizeable independent of a second phase winding and a third phase winding of the three phase windings to resist rotation of the permanent magnet motor.

* * * * *